US005143092A

United States Patent [19]

Flowers

[11] Patent Number: 5,143,092

[45] Date of Patent: Sep. 1, 1992

[54] FLEXIBLE ABDOMINAL FLATTENER

[76] Inventor: Vivian D. Flowers, 94 Sunnyslope Dr., Middletown, Conn. 06457

[21] Appl. No.: 684,264

[22] Filed: Apr. 12, 1991

[51] Int. Cl.[5] ..... A61F 5/37

[52] U.S. Cl. ..... 128/875; 128/876; 128/96.1; 2/406; 450/131; 450/133; 602/67

[58] Field of Search ..... 2/401, 402, 403, 406, 2/409; 128/845, 873-876, 883-885, 158, 159, 96.1; 450/131, 132, 114, 155, 151

[56] References Cited

U.S. PATENT DOCUMENTS

| | | | |
|---|---|---|---|
| Re. 23,334 | 1/1951 | Montmarquet | 128/158 |
| 2,137,130 | 11/1938 | Cartledge | 128/158 |
| 2,408,723 | 10/1946 | Arpin et al. | 128/158 |
| 3,029,814 | 4/1962 | Kravitz | 128/159 |
| 3,116,736 | 1/1964 | Alberts | 128/524 |
| 3,454,003 | 7/1969 | Sailhen | 128/96 |
| 3,524,449 | 8/1970 | Peters | 128/524 |
| 3,931,816 | 1/1976 | Waldmann | 128/78 |
| 3,963,022 | 6/1976 | Rotello | 128/158 |
| 4,586,199 | 5/1986 | Birring | 2/401 |
| 4,660,554 | 4/1987 | Wright | 128/158 |
| 4,679,554 | 7/1987 | Markham | 128/158 |
| 4,875,236 | 10/1989 | Boynton | 2/401 X |
| 4,961,419 | 10/1990 | Tribble et al. | 128/158 X |

OTHER PUBLICATIONS

British Medical Journal, Cindico Baby Bouncer, vol. 2, #5514 Inside front cover.

*Primary Examiner*—Robert A. Hafer
*Assistant Examiner*—Brian E. Hanlon
*Attorney, Agent, or Firm*—CTC & Associates

[57] ABSTRACT

A slimming flattener for the female's abdomen which utilizes two lengths of longitudinally stretchable woven elastic webbing in its construction. The first length surrounding the body at the upper hip line on the sides and rear dropping in the front to the mid abdomen. The second length is attached to the first length at the mid abdomen and extends down to and through the groin, then upward across the buttocks to be fastened to the rear of the first length at its mid point.

3 Claims, 2 Drawing Sheets

FLEXIBLE ABDOMINAL FLATTENER

BACKGROUND OF THE INVENTION

Flattening or minimization of mid-lower abdominal bulge has been of concern to women for many years. Many attempts have been made to solve the problem, to no avail. These attempts appear to inflict great discomfort by compressing the waist, buttocks and abdomen and even the thighs but have not resolved the problem bulge. Because such compression results in pushing the bulge into other areas of the anatomy creating bulges which show through to the outer garments.

It is an important object of the present invention to provide a simple means for assisting even the slender woman in the control of a protruding abdomen.

Another important object of the invention is to provide a slimming means for the abdomen that does not force the excess of the lower abdomen upward to the waist or laterally to the hips.

Another important object of the invention is to provide a slimming means for the upper hips and mid-abdomen wherein any excess is directed inward and downward eliminating unsightly bulges in outer garments.

Another important object of the invention is to provide a slimming means for the upper hips and abdomen which does not show any bulge through tot he outer garment even when worn under a tight fitting bathing or body suit.

Another important object of the invention is to provide a slimming means for the upper hips and abdomen which can be incorporated into and made part of tight fitting outer garments such as bathing suits or body suits.

PRIOR ART

A patentability search hereon revealed the following U.S. Patents:

| U.S. Pat. No. | Date | Inventor(s) |
|---|---|---|
| 3,029,814 | April 14, 1962 | Kravitz |
| 3,454,003 | July 8, 1963 | Sailhen |
| 3,116,736 | January 2, 1964 | Alberts |
| 3,524,449 | August 18, 1970 | Peters |
| 3,931,816 | January 13, 1976 | Waldman |

Kravitz discloses a supporting garment for the groin and abdominal areas primarily for men which combines very wide bands of elastic materials which supply support both laterally and longitudinally across the hips, abdomen and groin.

Albert discloses devices for supporting certain portions of the lower abdomen and groin for the control of varicose veins and other pathological conditions. Emphasis is placed to the vulval area to control varicose veins and other conditions during pregnancy.

Sailhen discloses an undergarment that is useful for aiding patients suffering hernia, essentially replacing trusses.

Peters discloses a girdle capable of effecting substantially parallel support of the abdominal and buttock muscles using a system of belts and straps and inserts.

Waldman discloses an adjustable corset to support the viscera using elastically directed panels and stiff reinforcing members to effect the support.

In addition to the above named U.S. Patents a search through the trade literature reveals a number of control briefs, panties, briefers, girdles and foundation garments. In general, these feature multi-directional elastic knit fabric which surrounds the abdominal area and back then, depending upon the degree and area of control, use single or multiple layers of bidirectional elastic with woven non-elastic but extendable fabrics.

None of the above mentioned art discloses the instant invention.

SUMMARY OF THE INVENTION

The flexible abdominal flattener (hereinafter flattener) of the instant invention utilizes a single type longitudinally stretchable elastic member both to surround the body at the upper hip line and which is held in place and assisted by an extension of similar longitudinally elastic fabric which drops downward from the elastic fabric surround, passes through the groin over the vulval area and upward to and fastened to the rear of the surround to exert downward pressure on the upper hip line on the sides and the rear and on the abdominal area thus acting to eleviate common female problems of abdominal area protrusion (also known as protruding tummy and/or apron tummy) and slight bulge of the upper hip line abdominal area being defined as the area of the abdomen extending from the lower umbilical area to the mid-upper area of the hypogastric area. On average the slight bulge starting somewhat below the waistline reaching its maximum protrusion somewhere in the vicinity of the widest part of the hipline.

The longitudinal elastic member is well known and supplied by a number of manufacturers. It is defined as a woven elastic webbing made elastic with strands of rubber therein incorporated which does not narrow when stretched, stretches only in the longitudinal direction, does not run when snagged, cannot be stretched in the transverse direction and is flexible in all directions.

Tenacity or the load needed to elongate the elastic web in the longitudinal direction may vary depending upon rubber strand content, thickness and width.

Typical properties of longitudinally stretchable fabric useful in the instant invention are described in the table below:

| Width | | Thickness | | Approximate Load (Tenacity) at 50% elongation | |
|---|---|---|---|---|---|
| inches | (cm) | inches | (mm) | lbs. | (kg) |
| 2" | (5) | .058 | (1.5) | 4.88 | (2.22) |
| | | .071 | (1.8) | 8.12 | (3.69) |
| 3" | (7.6) | .058 | (1.5) | 7.9 | (3.59) |
| | | .071 | (1.8) | 13.1 | (5.95) |
| 4" | (10.2) | .058 | (1.5) | 10.1 | (4.59) |
| | | .071 | (1.8) | 16.9 | (7.67) |

The final size or dimensions of the flattener will be determined by the size or dimensions of the wearer and the level of control required. Therefore it is anticipated that the commercial version of the abdominal support will be made available in a number of different sizes and support levels.

DETAILED DESCRIPTION

Figure 1:
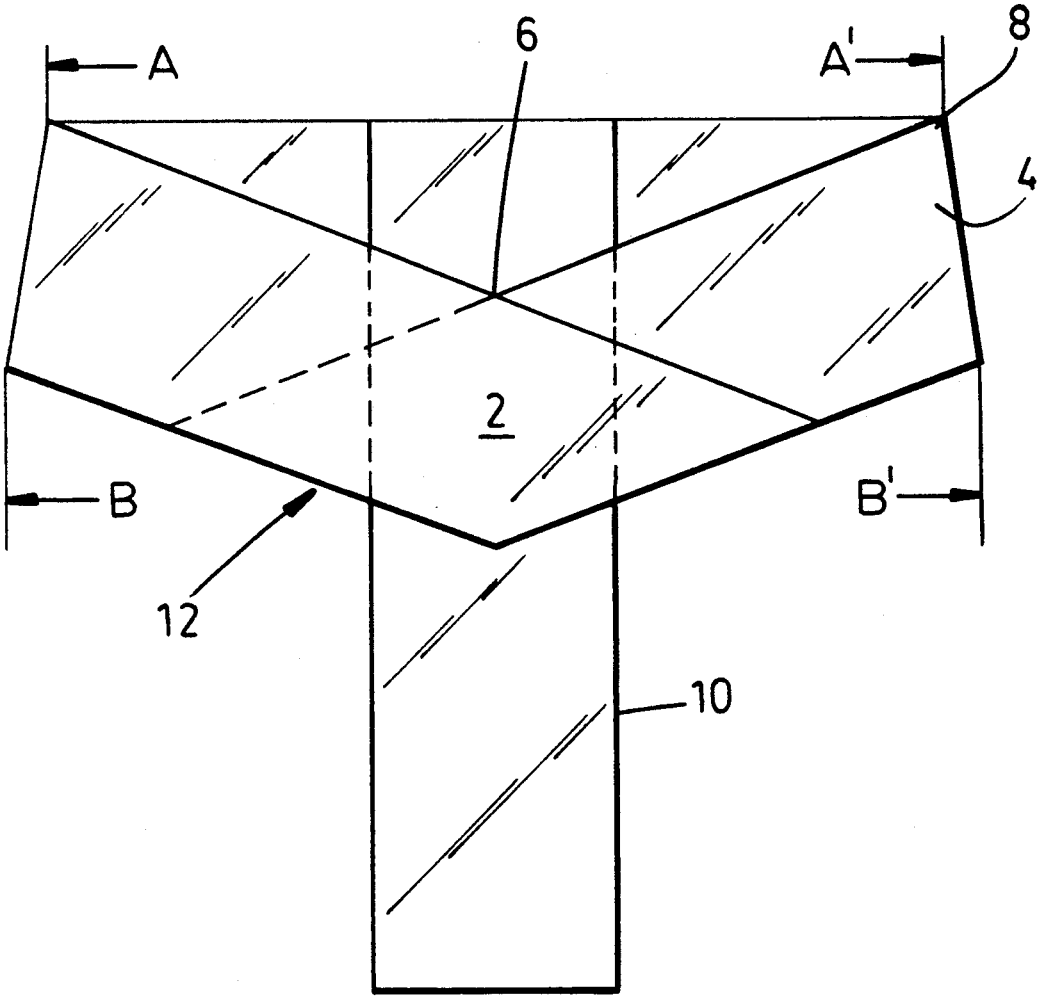
FIG. 1 is a frontal view of the support when not worn illustrating the overlap of the webbing to supply the optimum support in the abdomen.

As shown in FIG. 1 is a frontal view of abdominal support for a woman when not worn. It is fabricated from two lengths of similarly elastic material, each of the two lengths has two ends. The first and second ends of the first of two lengths overlap to form a continuous surround. The first end of the second length of similarly elastic overlaps and is attached to the overlap of the first and second end of the first length of similarly elastic material. The second end of the second length of similarly elastic material overlaps and is attached to the first length of similarly elastic material at the mid point of the surround of the attached overlap to form a loop between the overlap and the mid point of the surround. The attached overlap of the first and second ends of the first length and first end of the second length acting to eliminate elasticity of the similarly elastic material to supply maximum flattening in the needed abdominal area.

As stated, FIG. 1 is a frontal view of the flattener 12 illustrating the area 2 where the elastic webbing overlaps and develops maximum support for the wearer. Elasticity of the woven elastic webbing is eliminated at this point of cross over thus supplying maximum flattening in the needed area and no other areas. Surround 4 is a single continuous section of woven elastic webbing that surrounds the human form at the upper hip in the rear descending to the abdomen in the front at which point the ends cross over and overlap and attach to each other. The angle of crossover 6 is determined by the angle 8 which relates to the waist-upper hip angle on the human form. Typically angle 6 ranges from 145 degrees to 160 degrees and angle 8 varies from 100 degrees to 115 degrees. Length A—A' is determined by the measurement across the waist at the rear of the wearer typically varying from 11 inches (27.9 cm) to 18 inches (45.7 cm). Length B—B' is determined by the measurement across the wearer at the upper hip line. Typically varying from 12 inches (30.5 cm) to 20 inches (50.8 cm), elastic extension 10 overlaps and is perpendicularly attached to the mid point of rear of support 12 and to front at web overlap 2.

Figure 2:
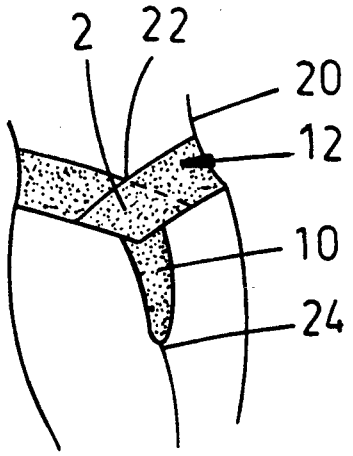
FIG. 2 is a frontal (slightly in perspective) view of the support when worn.
Figure 5:
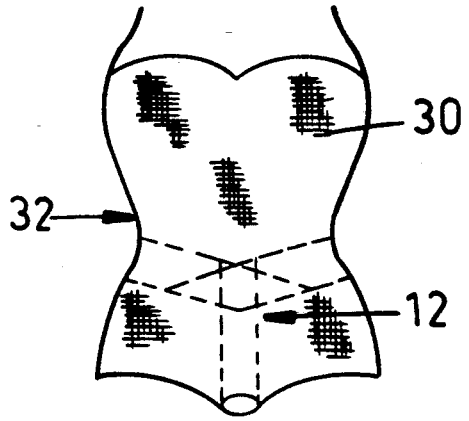
FIG. 5 demonstrates the flattener as would be incorporated into a bathing suit.
Figure 4:
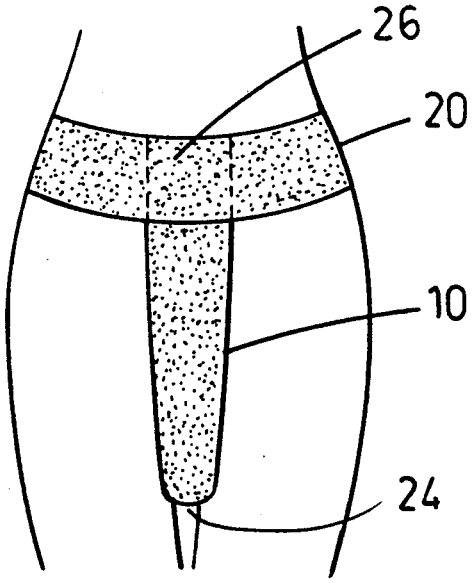
FIG. 4 is a rear view of the flattener illustrating the surround placed on the hip and extension as it eminates from the groin when worn.
Figure 3:
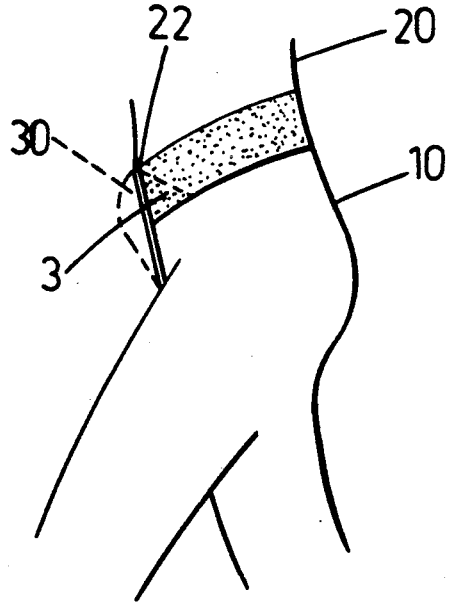
FIG. 3 is a side view illustrating the downward position of the support as it traverses the hips when worn.

When worn FIG. 2 the front portion of flattener 12 arcuately descends from the upper hip area 20 on the sides to rest and apply pressure immediately on the abdomen 22. Elastic extension 10 extends downward from overlap 2 to and through the groin 24. Ascending in the rear (FIG. 4) to perpendicularly meet, overlap and be attached to the mid-line 26 of flattener rear shown on upper hip line 20. Side view 3 illustrates in phantom the area of abdominal protrusion and the effect of crossover 2 of flattener 12 in applying pressure to eliminate the protrusion.

Flattener 12 may also conveniently be incorporated into and become part of a tight fitting elastic garment such as a bathing suit 32 wherein it is fastened to the inside of the fabric 30 and is covered by a liner that is usually incorporated into such garments.

Flattener is usually worn over panties or pantyhose so as not to come into contact with the body. Woven elastic webbing used in the construction of flattener may be made absorbent by utilizing cotton fiber to encapsulate the elastic rubber threads and be woven into its basic construction. Polyester or other non-absorbent synthetic fibers may also be used to encapsulate the elastic rubber threads and be woven into its basic construction if non-absorbency is desired.

The flexible flattener for the human abdominal area as herein described is a preferred form of the invention and although both specific and generic terms are used to describe the support and its function when worn. These are not for purposes of limitation, the scope of invention being defined in the claims which follow:

I claim:

1. A flattener for a women's lower and upper hypogastric abdominal area comprising: a surround and loop of longitudinally elastic material said surround being formed from a first single length of said elastic material, said single length having two ends said ends being truncated at an angle of at least 145° and not more than 160°, said angularly truncated ends overlapping, said overlap being attached to each other so as to from angles which result in a rigid diamond shaped overlap; said loop being formed from a second length of said elastic material, said second length of elastic material having two ends, the first of said two ends being forkedly truncated to conform to the angle formed by said first length overlap, said forked end being perpendicularly attached and made part of said overlap; said overlap of said ends of said first length and said forkedly truncated second end forming a rigid non elastic pad, said pad useful for applying downward pressure to said lower and upper hypogastric abdominal area; said second end being perpendicularly truncated, said perpendicularly truncated second end being perpendicularly truncated, said perpendicularly truncated second end being perpendicularly attached to the midpoint of said surround opposite said overlap of said first end of said second length and said first length overlap said surround and said loop forming said abdominal flattener.

2. The abdominal flattener of claim 1 which when worn said surround rests immediately above the hips on the sides and above the buttocks in the rear of said woman, said surround arcuately decending at the front to siad abdominal area, said surround having said loop extending downward to and passing through the groin and extending upward over the center of the buttocks to said surround in the rear, said surround and loop working in harmony to position said rigid diamond shaped overlap over said abdominal area, said loop passing through the groin supplying downward pressure on the upper hipline and on the abdominal area to elevate the common female problem of protruding tummy.

3. A method of eliminating a woman's protruding tummy by effecting downward pressure on said woman's lower umbilical and upper hypogastric abdominal area, said downward pressure being supplied by said flattener of claim 1 being work by said woman under said woman's outer clothes, said rigid diamond shaped overlap of said surround crossover and loop overlap effecting said downward pressure on said protruding tummy.

* * * * *